US006702792B2

(12) United States Patent
Nakamura et al.

(10) Patent No.: US 6,702,792 B2
(45) Date of Patent: Mar. 9, 2004

(54) FACE MASK HAVING EXCELLENT USABILITY

(76) Inventors: Kenji Nakamura, c/o Taika Awaji Factory, 3-41 Nishiawaji 6-chome, Higashi Yodogawa-ku, Osaka-shi, Osaka (JP); Koji Nakamura, c/o Taiki Awaji Factory, 3-41 Nishiawaji 6-chome, Higashi Yodogawa-ku, Osaka-shi, Osaka (JP)

( * ) Notice: Subject to any disclaimer, the term of this patent is extended or adjusted under 35 U.S.C. 154(b) by 0 days.

(21) Appl. No.: 10/289,476

(22) Filed: Nov. 6, 2002

(65) Prior Publication Data

US 2004/0022830 A1 Feb. 5, 2004

(30) Foreign Application Priority Data

Jul. 18, 2002 (JP) ..... 2002-209912

(51) Int. Cl.[7] ..... A61H 33/04; A61N 1/00
(52) U.S. Cl. ..... 604/303; 607/140
(58) Field of Search ..... 604/303; 607/139, 607/140; 424/78.02, 78.03, 484, 488; 514/844, 847

(56) References Cited

FOREIGN PATENT DOCUMENTS

| | | |
|---|---|---|
| JP | U 1-111519 | 7/1999 |
| JP | 11-228344 | 8/1999 |
| JP | 2000-063236 | 2/2000 |
| JP | U 3072027 | 7/2000 |
| JP | 2000-287751 | 10/2000 |
| JP | 2001-247441 | 9/2001 |
| JP | 2001-335427 | 12/2001 |

*Primary Examiner*—Weilun Lo
*Assistant Examiner*—Linh Truong
(74) *Attorney, Agent, or Firm*—Knobbe, Martens, Olson & Bear LLP

(57) ABSTRACT

A face mask folded and having one or more knob portions projecting outward, is characterized in that a cellulose nonwoven fabric with a basis weight of below 60 g/m$^2$ is used as a main sheet base material. The nonwoven fabric is reinforced by mixing synthetic fibers or by superimposing on one side or interposing a film. The nonwoven fabric has an elongation percentage of 30% or less at a tensile stress of 3.9 N/5 cm when being wetted, and a relative bending resistance of 5 mN·cm or less. The face mask is impregnated with a facial pack lotion, the viscosity of which is within the range of 0.5 to 10 Pa·sec, in an amount of 50% by weight or more based on the sheet base material.

9 Claims, 7 Drawing Sheets

[FIG. 1]
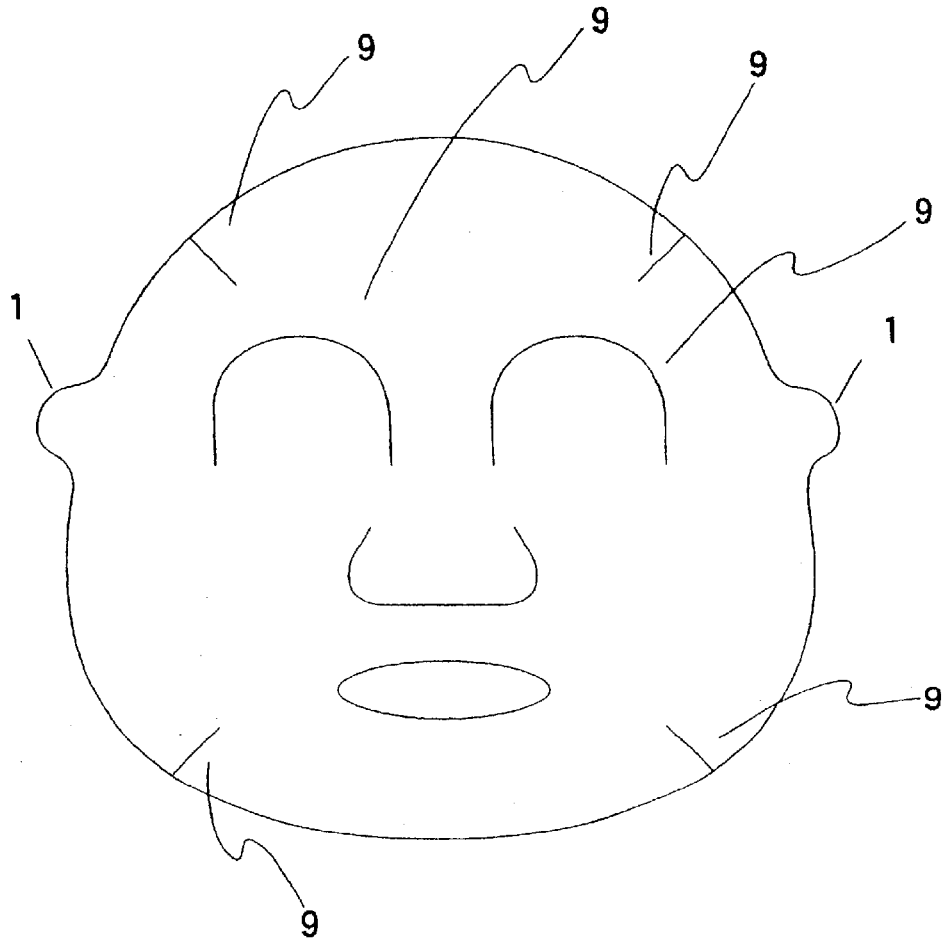

[FIG. 2]
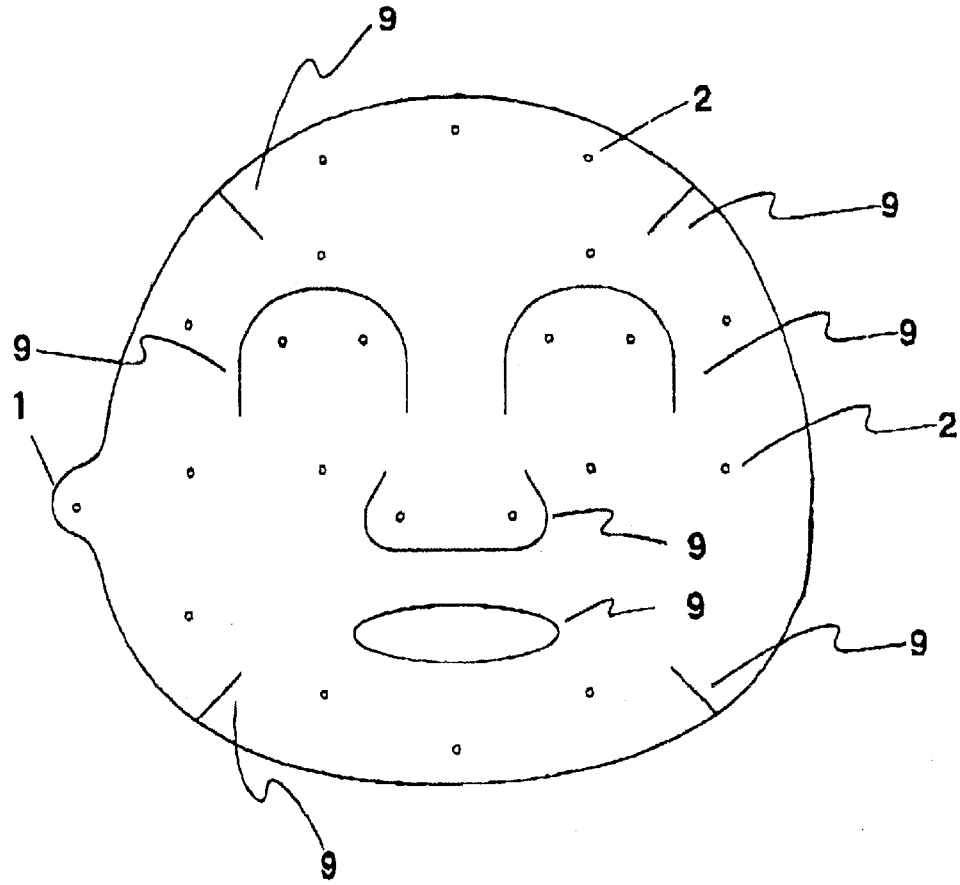

[FIG. 3]
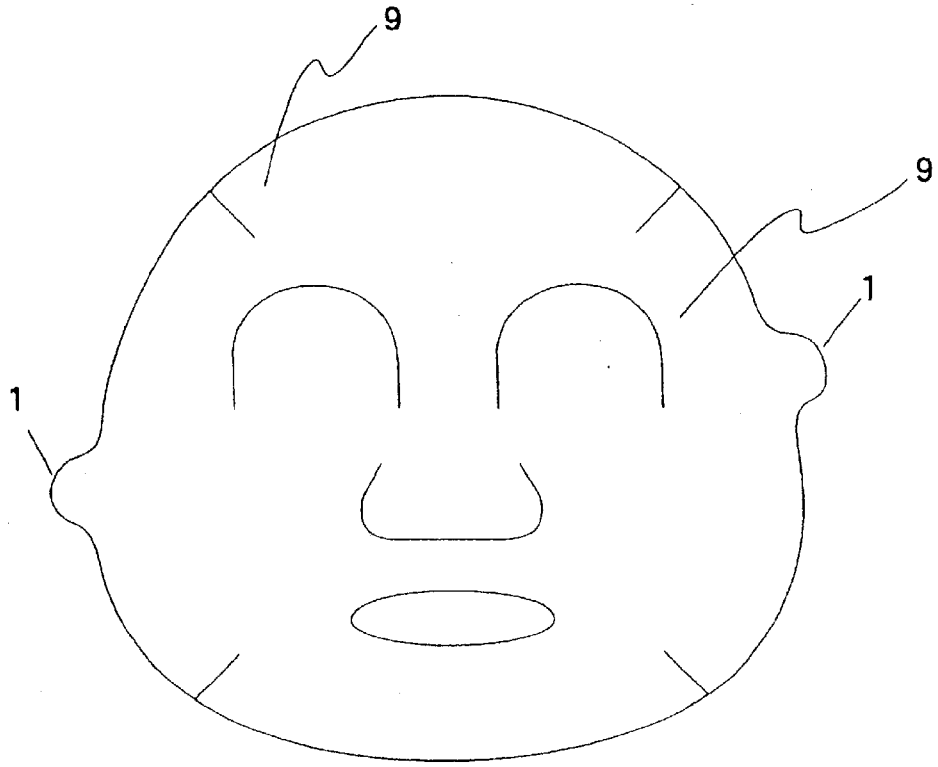
[FIG. 4]
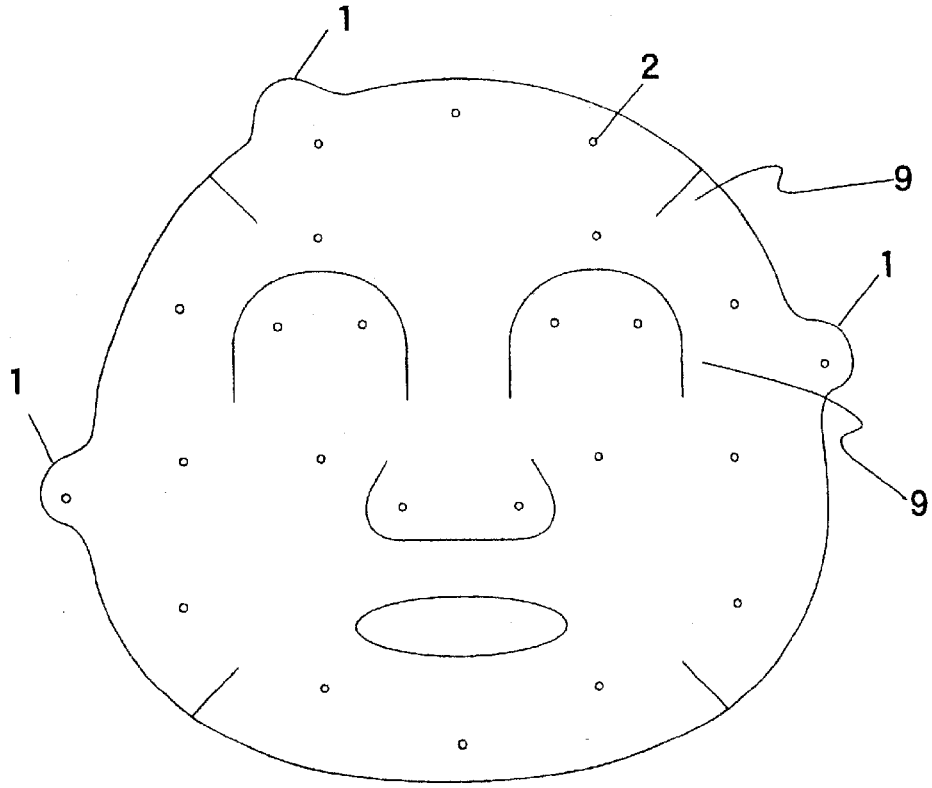

[FIG. 5]
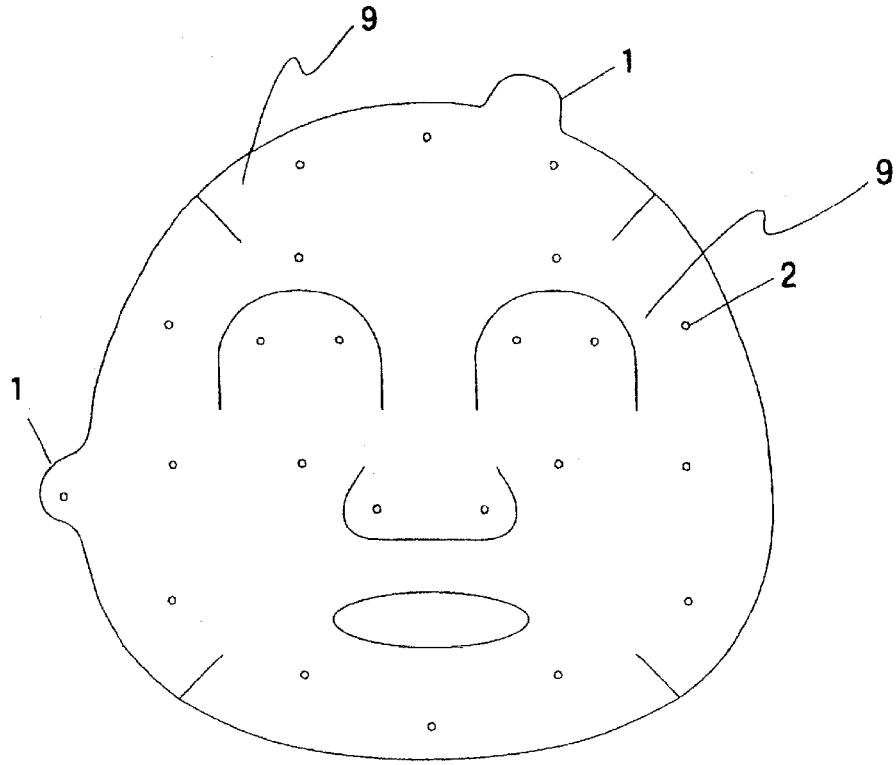
[FIG. 6]
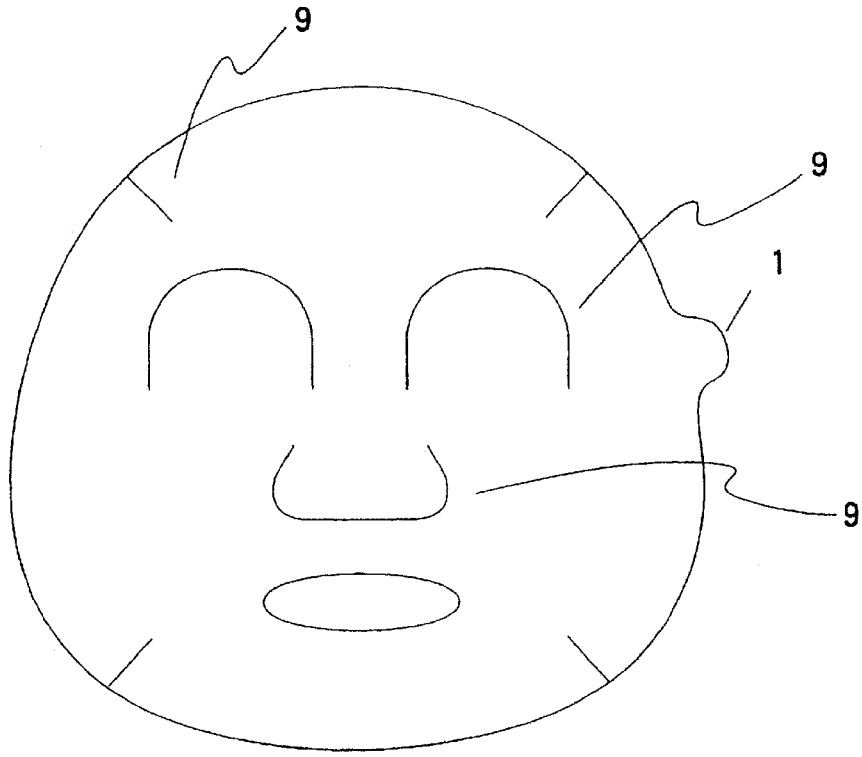

[FIG. 7]
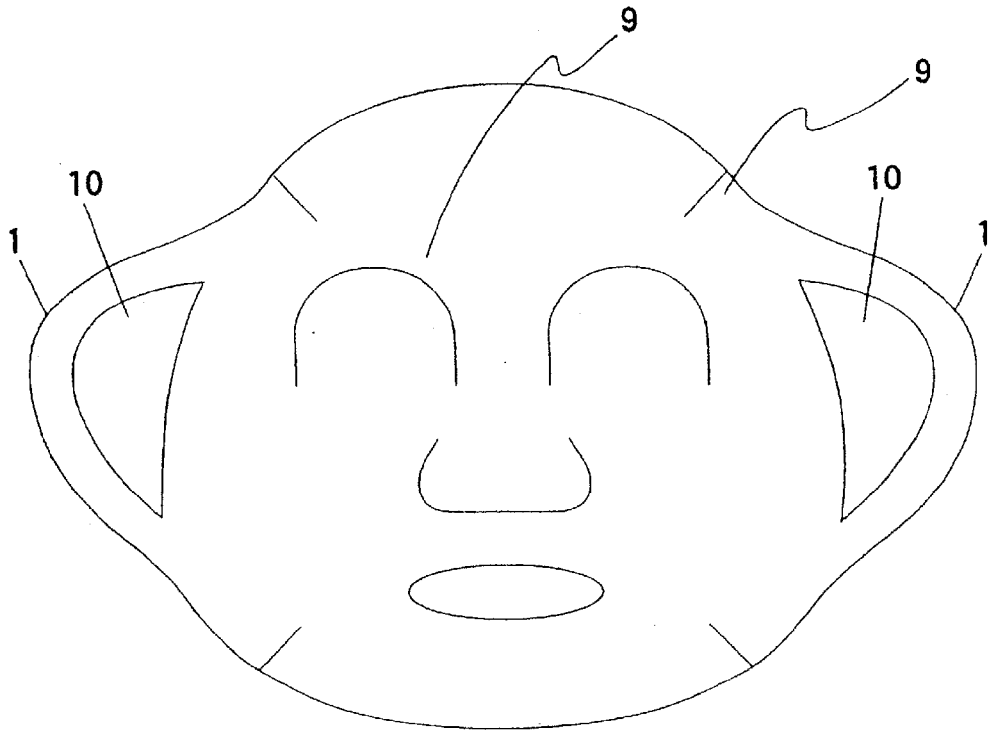
[FIG. 8]
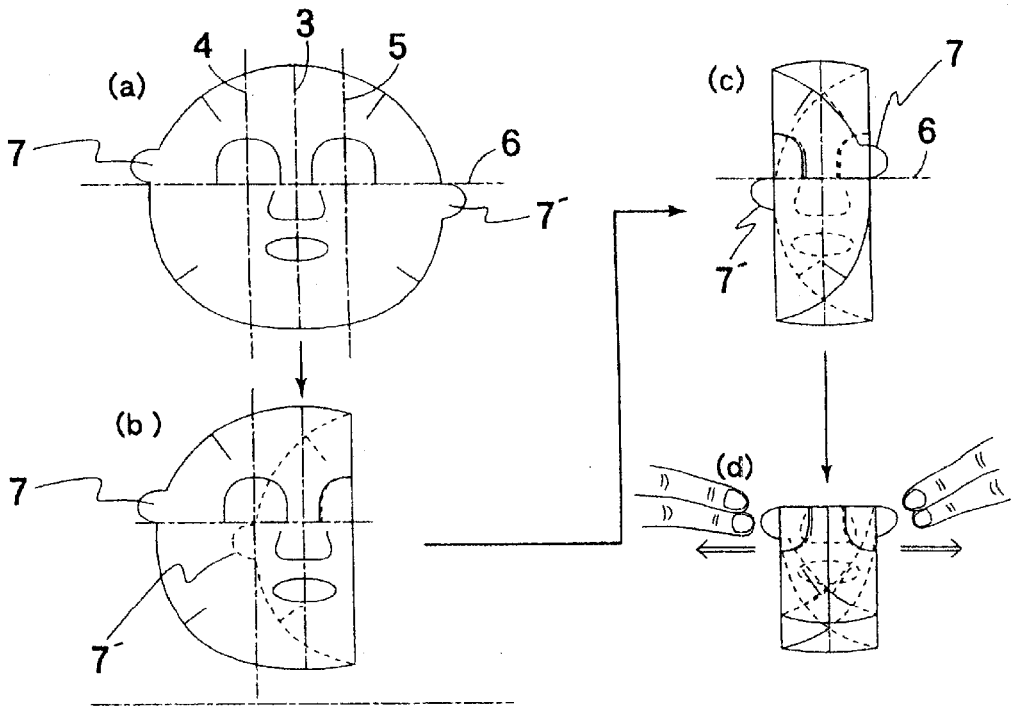

[FIG. 9]
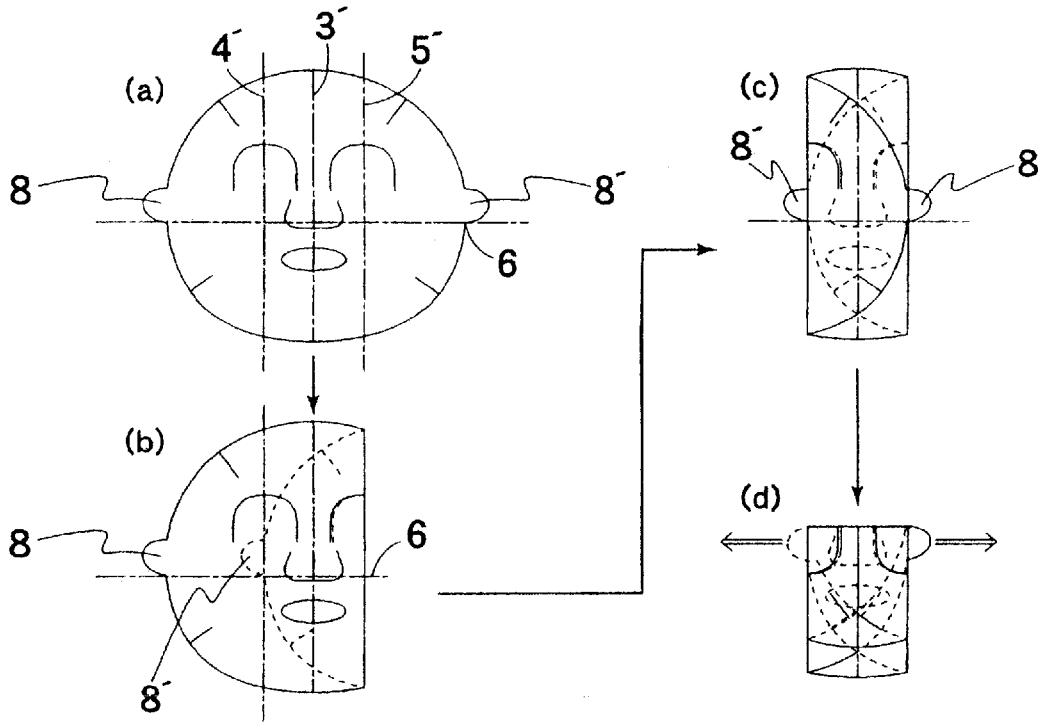
[FIG. 10]
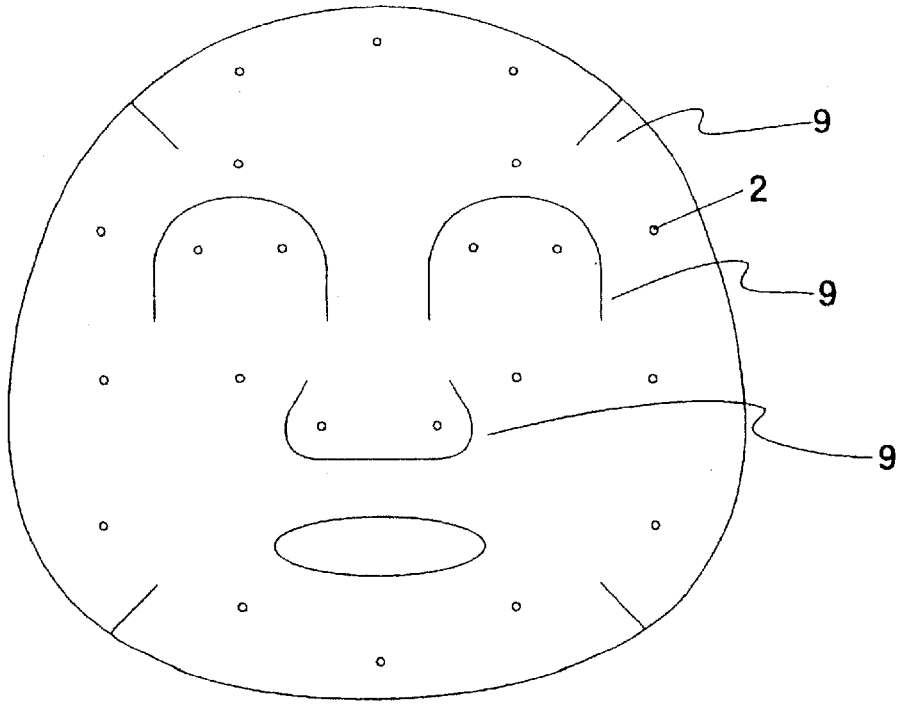

[FIG. 11]
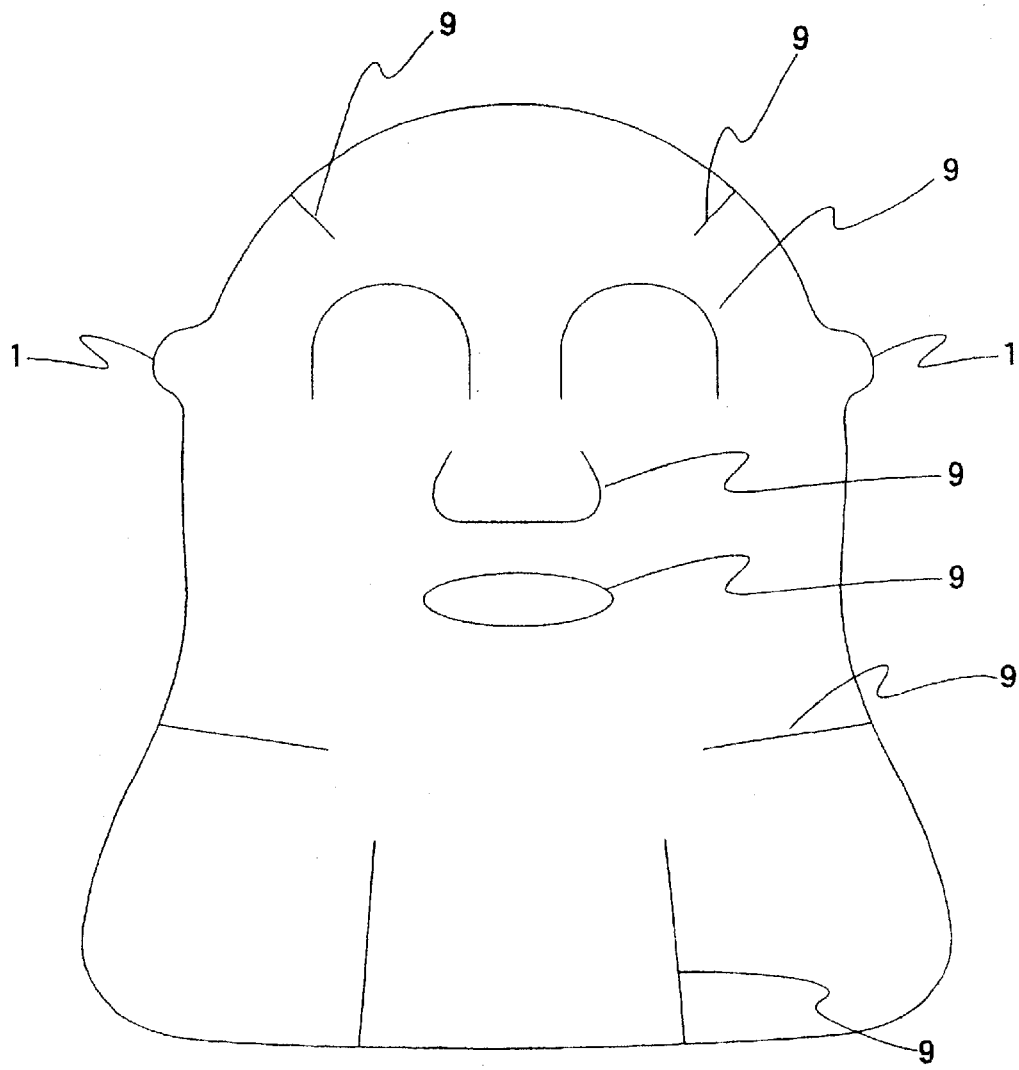

FACE MASK HAVING EXCELLENT USABILITY

BACKGROUND OF THE INVENTION

1. Field of the Invention

The present invention relates to so-called "impregnation type" face masks which are impregnated with a facial pack lotion and have at least one knob portion.

Additionally, the present invention relates to face masks which have knob portions, have excellent expandability and convenience and are fitted excellently.

In more detail, the present invention relates to impregnation type face masks, which can be easily unfolded or expanded evenly from a position in which a sheet base material is tightly folded by impregnation of a facial pack lotion, which are excellently convenient and which are fitted excellently and have excellent usability when applied for a long period of time.

2. Description of the Related Art

As one of cosmetic methods used from a long time ago, a method, in which a facial pack is applied to the skin surface for the purposes of moisturizing and supplying keratin of the skin and removing impurities or dirt from the skin surface, has been widely used.

Recently, demand for this type of facial packs is increasing encouraged by development of different facial packs used for different purposes including whitening the skin, reducing wrinkles and revitalizing the skin.

In the past, as facial packs, mainstream types were those which were applied to the face and wiped out or washed out after use. Applying those packs to the face was complicated and wiping them out after a facial pack was done was a lot of trouble. Later on, so-called peel-off types, in which facial packs were formed on the skin and peeled off from the skin after use, were introduced. Additionally, as different facial pack types, an attach-on type in which a jelly layer of a facial pack is provided on one side of a sheet base material (Japanese Patent Application Laid-open No.2001-247041) and an impregnation type in which a facial pack is impregnated in a base material were developed. Since then, product demand has surged.

As for the former attach-on type, those in which a jellied facial pack is coated on one side of a base sheet and a peel-off paper pattern is provided on top of it are popular. Because these attach-on type products have numerous manufacturing processes and are complicated, they are economically inefficient. Additionally, the thickness of these product types increases; they have high bending resistance, are not comfortable when applied, and are not suitable for application for long hours; a percentage of the active constituents of the facial pack to be infused into the skin from the jelly layer is low, approximately 3 to 5%. For these reasons, this type is unfit for a large-sized facial pack covering the entire face.

As compared with the former type, the impregnation facial pack type is a product type, which is made by impregnating a sheet base material including a thin nonwoven fabric with a facial pack agent having a viscosity lower than that of a gel used for the former attach-on type. This type has such advantages that it can be manufactured relatively easily, hence it is economical. This type is suitable for a large-sized facial pack, and its comfort when applied is relatively excellent. It has an advantage that a percentage of the active constituents of the facial pack to be infused into the skin of the face is by far higher than the attach-on type.

This impregnation facial pack type is made as follows: In a nonwoven base material with a size usually corresponding to the entire area of the face, small holes are made in places where the eyes and the mouth are and a cut is made in a place where the nose is, and a facial pack agent is infused in the base material. The impregnated material is folded in four or six and is commercialized by being enclosed in an airtight pouch package. This impregnated material folded needs to be taken out and unfolded or expanded when used. Regarding the process of unfolding or expanding the folded material, however, there was a problem that folded and overlapped portions of the material cohered by the adhesiveness of a facial pack lotion and unfolding the impregnated material was difficult. Moreover, there were more problems that the facial pack lotion adhered directly to hands and smeared hands and clothes. For these reasons, to improve a facial pack material to be easily unfolded and expanded, an impregnation type face mask, in which a resin film with pores made is superimposed on nonwoven fabric, was proposed (Japanese Patent Application Laid-open No.2000-287751). In this invention, however, facial pack constituents infused in the nonwoven fabric escaped from the pores made in the resin film and did not return to the nonwoven fabric. As the result, the facial pack was wasted and hands and clothes were smeared. Besides, difficulty in unfolding the material was not able to be solved.

For the purpose of facilitating unfolding of a folded face mask, the inventors of the present invention proposed to improve the difficulty in unfolding the face mask by providing at least two knob portions projecting outward in the rim of a sheet base material with which the facial pack agent is infused (Japanese Utility Model Patent No.3072027). With this invention, if a thin nonwoven fabric was used in order to accommodate consumers' need calling for use of thinner sheet base materials, thin nonwoven base materials were deformed or torn if pulled at the knob portions of the sheet base material with both hands. Additionally, a problem in smearing clothes was not able to be solved.

SUMMARY OF THE INVENTION

Consequently, the inventors of the present invention have proposed an impregnation type face mask in which tensile physical property was reinforced by laminating a film for cutting off liquid on a sheet base material and knob portions were formed (Japanese Patent Application No. 2001-333306, not yet published) and an impregnation type face mask reinforced by mixing synthetic fibers in a cellulose nonwoven fabric (Japanese Patent Application No. 2002-103798, not yet published). Problems in unfolding and expanding of the face mask, however, were not sufficiently resolved.

To obtain a face mask having better quality when it is unfolded and expanded, after working assiduously, the inventors of the present invention have found that by designating physical attributes, e.g., a specific range of elongation percentages when being wetted, a degree of bending resistance, and viscosity of lotion to be infused, to the sheet base material for face masks described in the Japanese Patent Application No. 2001-333306 and No. 2002-103798, a face mask can be provided which can be unfolded easily and has excellent quality when unfolded and expanded and excellent convenience and which can be fitted excellently and is comfortable when applied.

Consequently, it was found that a face mask possessing excellent qualities when unfolded and expanded and excellent convenience according to an embodiment of the present invention has the following characteristics:

(1) By using a thin sheet base material with bending resistance as low as possible, a face mask can be better fitted and has better usability.

(2) The viscosity of facial pack lotion, which is infused in the sheet base material, is adjusted to an appropriate range.

(3) The sheet base material is made using a thin cellulose nonwoven fabric with a basis weight of 60 g/m$^2$ or less and by making holes in places where the eyes, the nose and the mouth are. In a condition that facial pack lotion is infused in the sheet base material, the sheet base material is unfolded and expanded easily by pulling one or more knob portions projecting outward with both hands.

(4) The sheet base material cannot be deformed or torn when it is expanded by holding the knob portions.

The face mask according to an embodiment of the present invention has excellent qualities when expanded and unfolded and excellent convenience. The facial pack can be excellently fitted and is comfortable when applied. Unlike the facial pack for the above-mentioned attach-on type, because this type of facial pack is applied to the face for long hours in order to allow its constituents to be infused into the skin adequately, the effectiveness of the facial pack is by far better than the attach-on type. This face mask can satisfy consumers' requests for usability for long hours and adhesion to the face, well-fittedness to the face and others.

The basics of the face mask according to the present invention include, but are not limited to, the following:

(1) An impregnation type face mask using a cellulose nonwoven fabric with a basis weight of 60 g/m$^2$ and less as a sheet base material and possessing at least one knob portion projecting outward and the base material is folded, which is characterized in that the nonwoven base material is reinforced and has an elongation percentage of 30% or less at a tensile stress of 3.9 N/5 cm when being wetted, and a relative bending resistance of 5 mN·cm or less when being wetted pursuant to JISL1913 (1998) cantilever method, and said face mask is made by impregnating the material with a facial pack lotion having a viscosity of 0.5 to 10 Pa·sec by 50 wt % or more.

(2) The face mask as mentioned in (1) above, which is characterized in that the cellulose nonwoven fabric sheet is a sheet base material which is reinforced by combining with synthetic fiber.

(3) The face mask as mentioned in (1) or (2) above, which is characterized in that, in the sheet base material, the facial pack lotion has a viscosity of 0.8 to 8 Pa·sec and is infused by 50 wt % or more based on the material.

(4) The face mask as mentioned in (1) above, which is characterized in that the cellulose nonwoven fabric sheet is reinforced by superposing a resin film having pores on its single side or interlayer.

(5) The face mask as mentioned in (4) above, which is characterized in that the superposition is thermally bonded in a punctiform manner.

(6) The face mask as mentioned in (1), (4) or (5) above, which is characterized in that, in the sheet base material, the facial pack lotion has a viscosity of 0.8 to 3 Pa·sec and is infused by 50 wt % or more.

(7) The face mask as mentioned in any one of (1) to (6) above, which is characterized in that the face mask has a shape covering a face and a neck and having a score formed at least in a region dividing the face and the neck.

(8) The face mask as mentioned in any one of (1) to (7) above, which is characterized in that a structure having portions to be placed over ears is provided to ensure application of the mask to the entire face.

Unlike an attach-on type face mask using high viscosity gel, the impregnation-type face mask according to an embodiment of the present invention does not disturb cutaneous respiration. When applied, because it requires long time before the infused lotion evaporates, the active constituents can be infused into the skin slowly. If a ratio of facial pack lotion infused in a sheet base material is 50% or less, the material becomes too dry and becomes difficult to stay on the face. With the knob portions to be placed over the ears, however, the material can stay on the face after it dries out on the skin surface. A shape of the sheet base material with the portions to be placed over ears can be as shown in FIG. 7. This structure can be altered to have both the holding portions and portions to be placed over ears by attaching a string or a tape on the sheet base material.

For purposes of summarizing the invention and the advantages achieved over the prior art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

FIG. 1 shows a plan view of the face mask according to an embodiment of the present invention.

FIG. 2 shows plan view of the face mask according to an embodiment of the present invention in a different shape.

FIG. 3 shows plan view of the face mask according to an embodiment of the present invention in a different shape.

FIG. 4 shows plan view of the face mask according to an embodiment of the present invention in a different shape.

FIG. 5 shows plan view of the face mask according to an embodiment of the present invention in a different shape.

FIG. 6 shows plan view of the face mask according to an embodiment of the present invention in a different shape.

FIG. 7 shows plan view of the face mask according to an embodiment of the present invention in a different shape.

FIG. 8 shows a process chart of folding the face mask according to an embodiment of the present invention.

FIG. 9 shows a different process chart of folding the face mask according to an embodiment of the present invention.

FIG. 10 shows plan view of the face mask of a comparative example.

FIG. 11 shows plan view of the face mask according to an embodiment of the present invention in a different shape.

DETAILED DESCRIPTION OF THE PREFERRED EMBODIMENT

The basic structure of the face mask according to an embodiment of the present invention is a face mask used for facial pack use, which has at least one knob portion projecting outward when the base material is folded. The number of folds is not specified, but folding the facial mask in four to six is adequate. To make the facial mask better fitted and comfortable in use, by using a thin nonwoven fabric formed from hydrophillic cellulose fabric such as cotton and rayon as a sheet base material and by impregnating the fabric with a water-based facial pack lotion, a high impregnation rate can be maintained. For this reason, without need for using high-viscosity gel, a face mask which can be applied to the face can be formed.

The face mask according to an embodiment of the present invention is described below by referring to figures. FIG. 1 to FIG. 7 and FIG. 11 show a plan view and variants of the face mask according to an embodiment of the present invention. FIG. 8 and FIG. 9 show a folded conceptual diagram and a variant of the face mask according to an embodiment of the present invention. FIG. 10 shows a plan view of the face mask in a comparative example.

FIG. 1 shows a basic structure of the face mask according to an embodiment of the present invention. Knob portions are indicated as reference numeral 1. Contact points made by thermal bonding are indicated as reference numeral 2, and scores are indicated as reference numeral 9. A mouth portion enclosed by a score can be cut off if appropriate. A folding process is described in FIG. 8. A face mask (a) is first folded along a vertical folding line 5 by folding the right side toward the back side of the face mask (b). The left side is folded toward the front side of the face mask along a vertical folding line 4 (c). An upper half is folded along a horizontal folding line 3 toward the front side of the face mask (d). When used (expanded), by holding knob portions 7 and 7' and expanding the face mask by reversing the order mentioned above, the face mask can be expanded to its original unfolded condition (a). The face mask is applied to the face in this unfolded condition. The face mask shown in FIG. 9 is also folded in the same way as done in FIG. 8 and can be expanded by holding knob portions 8 and 8'.

As for a nonwoven base material used for an embodiment of the present invention, cellulose-fiber-based fabric such as cotton and rayon is appropriate. The nonwoven base material can also be reinforced by synthetic fibers such as polyester, polyolefin or nylon fibers. An amount of these synthetic fibers to be mixed needs to be determined in consideration of the tensile elasticity and bending resistance of the nonwoven fabric.

Usable thinness of nonwoven fabric for a sheet base material in the face mask according to an embodiment of the present invention should be thinness with a basis weight of 60 g/m$^2$ or less, preferably with a basis weight of 50 g/m$^2$ or less, and further preferably with a basis weight of 40 g/m$^2$ or less. The lower the basis weight of a sheet base material is, the better the sheet base material can be fitted and comfortable in use. There are problems that such a thin nonwoven fabric can be deformed or torn when expanded by holding the knob portions. With a basis weight of more than 60 g/m$^2$, although tensile strength is improved, fittedness and comfort of the face mask in use worsen.

To reinforce the thin cellulose nonwoven fabric so that it cannot be deformed or torn by a pull at the knob portions when expanding the face mask, there are means for reinforcing the nonwoven fabric by mixing synthetic fibers in a cellulose raw material or by superimposing a resin film on cellulose nonwoven fabric. Using any one of these means, an elongation percentage should be 30% or less at a tensile stress of 3.9 N/5 cm when the sheet base material is wetted, preferably 20% or less.

In an embodiment of the present invention, a tensile stress of 3.9 N/5 cm when the sheet base material is wetted implies that the contact condition of the sheet base material infused facial pack lotion was specified based on stress when unfolding the facial mask by pulling the knob portions. In the case of a sheet base material with an elongation percentage of 30% or more at a tensile stress of 3.9 N/5 cm, deformation when unfolding a face mask is considerable and the face mask is easily damaged, hence the material is unfit for a face mask.

Having appropriate bending resistance is important for a face mask to be properly fitted and to provide comfort when applied to the face. In the face mask according to an embodiment of the present invention, therefore, it is necessary to use a soft sheet base material with bending resistance of 5 mN·cm or less pursuant to the JISL1913 (1998) cantilever method. In the case of a sheet base material with bending resistance of 5 mN·cm or more, the material is not suitable because fittedness of the material to the face is bad and comfort in use deteriorates.

Because facial pack lotion according to an embodiment of the present invention is of an impregnation type, it is not necessary to use high-viscosity gel used for the attach-on type. For the facial pack lotion used in an embodiment of the present invention, viscosity can be changed by a constituent such as gel or protein, and facial pack lotion particularly with low viscosity of 0.5 to 10 Pa·sec can be used. Facial pack lotion with low viscosity of 0.5 Pa·sec or less, however, is not suitable, because it cannot adhere to the skin well in use.

In an embodiment of the present invention, to reinforce a cellulose-fiber-based nonwoven fabric used for a sheet base material, synthetic fibers are mixed or resin films are superimposed on one side or both sides of the nonwoven fabric. In the case of a sheet base material reinforced by synthetic fibers, preferably facial pack lotion with viscosity of 0.8 to 8 Pa·sec, further preferably with viscosity of 1.5 to 6 Pa·sec, is used. In the case of facial pack lotion with viscosity of 10 Pa·sec or more, impregnation performance is not satisfactory. In the case of viscosity of 0.5 Pa·sec or less, because of too low viscosity, there is a problem in manufacturing process and it is unfit for use.

When a sheet base material reinforced by superimposing resin films on the nonwoven fabric is used, facial pack lotion with viscosity of 0.8 to 3 Pa·sec, preferably with viscosity of 1.0 to 2.5 Pa·sec, is used. In the case of facial pack lotion with viscosity of 3 Pa·sec or more, influenced by superimposed films, capillary permeation effect on the nonwoven fabric is poor.

The raw material of a resin film used for reinforcing the nonwoven fabric is not specified so much. If polyethylene or polypropylene is used, however, a resin film, which has a property of blocking liquid, should have thickness of approximately 5 to 50 $\mu$m, preferably of 20 $\mu$m or less. It is appropriate that a nonwoven fabric and a resin film are superimposed by thermal bonding in a punctiform manner.

Additionally, if a facial pack leaks out in large quantity from pores made in the resin film, the facial pack does not return to the nonwoven fabric again. A film having large pores is not preferred, as the facial pack leaks out from the pores. Microscopic holes to the size, from which large quantity of the facial pack does not leak out, can be made in the resin film using electric discharging or a mechanical method.

Additionally, for superimposition of the nonwoven fabric and the resin film, laminating or partial bonding is used.

When two knob portions are provided, by making the knob portions to be able to be placed over ears, the facial mask can stay on the face for use for long hours such as during sleep and the face mask dries out, and the active constituents of the facial pack can be adequately infused into the skin.

Furthermore, one of preferred modes for carrying out the present invention is a face mask having a shape covering at least the face and the neck. The face mask can have a shape covering the neck in addition to the face or a shape that can cover the upper chest and the shoulders in addition to the face and the neck. To improve fittedness and adhesion of the face mask to respective regions, a score is provided in a region dividing the face and the neck. Instead of providing the score, the regions can be cut off, or the regions can be partially linked by a perforation. It is preferable to form a score at least in a region dividing the face and the neck. If the score is not provided, proper adhesion cannot be achieved. How a score is provided or designed is not particularly limited. For a purpose of increasing adhesion, it is preferable to select the number and length of scores appropriately.

Modes for carrying out embodiments of the present invention are described below. The present invention should not be limited to these modes for carrying out the embodiments of the present invention described below.

Embodiment 1

A face mask base material was prepared by thermally bonding a cotton spun-laced nonwoven fabric (basis weight: 30 g/m$^2$) as the cellulose nonwoven fabric and a synthetic fiber nonwoven fabric ("Eleves"™ manufactured by UNITIKA LTD., basis weight: 20 g/m$^2$), the core portion of which synthetic fiber nonwoven fabric is polyethyleneterephthalate and the sheath portion of which synthetic fiber nonwoven fabric is polyethylene, in a punctiform manner.

This sheet base material was wetted using a method provided in JIS L1913 (established in 1998). The wet bending hardness of a wetted sample (sample size: 2.5 cm×25 cm), which was calculated using the cantilever method, and the tensile elongation percentage of a wetted sample (sample size: 5 cm×30 cm) when stress of 3.9N was applied was measured using a constant-speed elongation tension tester (testing speed: 100 mm/min). The sheet base material had a wet bending hardness (G) of 2 (mN·cm) and a tensile elongation percentage (E) of 8% when a stress of 3.9 N was applied to the wet sample. The base material had moderate flexibility and deforming tolerance as a face mask material.

This sheet base material was punched out using a Thomson blade and a face mask having a knob portion on the observer's left as shown in FIG. 2 was made.

After folded in six as shown in FIG. 8, the mask was inserted in a bag made of polyethylene laminated film, and facial pack lotion with viscosity of 2.3 Pa·sec was poured in by weight of 5.5 times more than the dry base material's. The top of the bag was heat-sealed and a sealed product was manufactured.

After opening the sealed bag of the product obtained and taking the product out from the bag, the face mask was expanded by holding the knob portion. The face mask was able to be unfolded easily without its overlapped portions adhering to each other.

Additionally, when applied to the face, the face mask was fitted well and comfortable without excessive facial pack lotion dripping and smearing clothes and with less stickiness left on hands and had exceedingly excellent usability. Furthermore, when the face mask was applied for long hours to the face, no stuffiness was felt and low moisture loss of the facial pack lotion occurred.

Additionally, the facial pack lotion was evenly infused inside the fold structure of the folded face mask product and a rate of the facial pack lotion infused was 530 wt %.

Embodiment 2

A face mask base material comprising spun-laced nonwoven fabric (basis weight: 30 g/m$^2$), in which rayon by 70 wt % as a cellulose constituent and polyethyleneterephthalate by 30 wt % as synthetic fibers were mixed in, was prepared.

This sheet base material was wetted using a method provided in JIS L1913 (established in 1998). Values G and E were calculated using the same methods used in Embodiment 1. The sheet base material had a wet bending hardness (G) of 1 (mN·cm) and a tensile elongation percentage (E) of 19%. The base material had moderate flexibility and deforming tolerance as a face mask material.

This sheet base material was punched out using a Thomson blade, and a face mask having knob portions symmetrically on the right and the left as shown in FIG. 1 was made.

After folded in six as shown in FIG. 9, the mask was inserted in a bag made of polyethylene laminated film, and facial pack lotion with viscosity of 4.7 Pa·sec was poured in by weight of 7 times more than the dry base material's. The top of the bag was heat-sealed and a sealed product was manufactured.

After opening the sealed bag of the product obtained and taking the product out from the bag, the face mask was expanded by holding the knob portions. The face mask was able to be unfolded easily without its overlapped portions adhering to each other.

Additionally, when applied to the face, the face mask was fitted well and comfortable without excessive facial pack lotion dripping and smearing clothes and with less stickiness left on hands and had excellent usability. Furthermore, when the face mask was applied for long hours to the face, no stuffiness was felt and low moisture loss of the facial pack lotion occurred.

Additionally, the facial pack lotion was evenly infused inside the fold structure of the folded face mask product and a rate of the facial pack lotion infused was 690 wt %.

Embodiment 3

A face mask base material was prepared by laminating a cotton spun-laced nonwoven fabric (basis weight: 40 g/m$^2$) as the cellulose nonwoven fabric and a nylon 6 spun-bonded nonwoven fabric (basis weight: 30 g/m$^2$) as a synthetic fiber nonwoven fabric and then entwining fibers by hydroentanglement.

This sheet base material was wetted using a method provided in JIS L1913 (established in 1998). Values G and E were calculated using the same methods used in Embodiment 1. The sheet base material had a wet bending hardness (G) of 2 (mN·cm) and a tensile elongation percentage (E) of 13%. The base material had moderate flexibility and deforming tolerance as a face mask material.

This sheet base material was punched out using a Thomson blade, and a face mask having knob portions symmetrically on the right and the left as shown in FIG. 1 was made.

After folded in six as shown in FIG. 9, the mask was inserted in a bag made of polyethylene laminated film, and facial pack lotion with viscosity of 2.4 Pa·sec was poured in by weight of 5.5 times more than the dry base material's. The top of the bag was heat-sealed and a sealed product was manufactured.

After opening the sealed bag of the product obtained and taking the product out from the bag, the face mask was expanded by holding the knob portions. The face mask was able to be unfolded easily without its overlapped portions adhering to each other.

Additionally, when applied to the face, the face mask was fitted well and comfortable without excessive facial pack lotion dripping and smearing clothes and with less stickiness left on hands and had excellent usability. Furthermore, when the face mask was applied for long hours to the face, no stuffiness was felt and low moisture loss of the facial pack lotion occurred.

Additionally, the facial pack lotion was evenly infused inside the fold structure of the folded face mask product and a rate of the facial pack lotion infused was 510 wt %.

Embodiment 4

A face mask base material was prepared by laminating a cotton spun-laced nonwoven fabric (basis weight: 40 g/m$^2$) and a nylon 6 mesh fabric (basis weight: 25 g/m$^2$) as the cellulose nonwoven fabric and then entwining fibers by hydroentanglement.

This sheet base material was wetted using a method provided in JIS L1913 (established in 1998). Values G and E were calculated using the same methods used in Embodiment 1. The sheet base material had a wet bending hardness (G) of 1 (mN·cm) and a tensile elongation percentage (E) of 10%. The base material had moderate flexibility and deforming tolerance as a face mask material.

This sheet base material was punched out using a Thomson blade, and a face mask having knob portions asymmetrically on the right and the left as shown in FIG. 3 was made.

After folded in six as shown in FIG. 8, the mask was inserted in a bag made of polyethylene laminated film, and facial pack lotion with viscosity of 5.7 Pa·sec was poured in by weight of 8 times more than the dry base material's. The top of the bag was heat-sealed and a sealed product was manufactured.

After opening the sealed bag of the product obtained and taking the product out from the bag, the face mask was expanded by holding the knob portions. The face mask was able to be unfolded easily without its overlapped portions adhering to each other.

Additionally, when applied to the face, the face mask was fitted well and comfortable without excessive facial pack lotion dripping and smearing clothes and with less stickiness left on hands and had excellent usability. Furthermore, when the face mask was applied for long hours to the face, no stuffiness was felt and low moisture loss of the facial pack lotion occurred.

Additionally, the facial pack lotion was evenly infused inside the fold structure of the folded face mask product and a rate of the facial pack lotion infused was 720 wt %.

Embodiment 5

A face mask base material was prepared by thermally bonding a rayon spun-laced nonwoven fabric (basis weight: 40 g/m$^2$) as the cellulose nonwoven fabric and a synthetic nonwoven fabric, "Eleves"™ (manufactured by UNITIKA, basis weight: 30 g/m$^2$) in a punctiform manner.

This sheet base material was wetted using a method provided in JIS L1913 (established in 1998). Values G and E were calculated using the same methods used in Embodiment 1. The sheet base material had a wet bending hardness (G) of 3 (mN·cm) and a tensile elongation percentage (E) of 4%. The base material had moderate flexibility and deforming tolerance as a face mask material.

This sheet base material was punched out using a Thomson blade, and a face mask having knob portions symmetrically on the right and the left as shown in FIG. 1 was made.

After folded in six as shown in FIG. 9, the mask was inserted in a bag made of polyethylene laminated film, and facial pack lotion with viscosity of 2.2 Pa·sec was poured in by weight of 3 times more than the dry base material's. The top of the bag was heat-sealed and a sealed product was manufactured.

After opening the sealed bag of the product obtained and taking the product out from the bag, the face mask was expanded by holding the knob portions. The face mask was able to be unfolded easily without its overlapped portions adhering to each other.

Additionally, when applied to the face, the face mask was fitted well and comfortable without excessive facial pack lotion dripping and smearing clothes and with less stickiness left on hands and had excellent usability. Furthermore, when the face mask was applied for long hours to the face, no stuffiness was felt and low moisture loss of the facial pack lotion occurred.

Additionally, the facial pack lotion was evenly infused inside the fold structure of the folded face mask product and a rate of the facial pack lotion infused was 280 wt %.

Embodiment 6

A face mask base material was prepared by laminating a rayon spun-laced nonwoven fabric (basis weight: 40 g/m$^2$) and a spun-bonded nonwoven fabric (basis weight: 30 g/m$^2$) made of polyethyleneterephthalate and then entwining fibers by hydroentanglement.

This sheet base material was wetted using a method provided in JIS L1913 (established in 1998). Values G and E were calculated using the same methods used in Embodiment 1. The sheet base material had a wet bending hardness (G) of 4 (mN·cm) and a tensile elongation percentage (E) of 11%. The base material had moderate flexibility and deforming tolerance as a face mask material.

This sheet base material was punched out using a Thomson blade, and a face mask having knob portions asymmetrically on the right and the left as shown in FIG. 3 was made.

After folded in six as shown in FIG. 8, the mask was inserted in a bag made of polyethylene laminated film, and facial pack lotion with viscosity of 2.0 Pa·sec was poured in by weight of 6 times more than the dry base material's. The top of the bag was heat-sealed and a sealed product was manufactured.

After opening the sealed bag of the product obtained and taking the product out from the bag, the face mask was expanded by holding the knob portions. The face mask was able to be unfolded easily without its overlapped portions adhering to each other.

Additionally, when applied to the face, the face mask was fitted well and comfortable without excessive facial pack lotion dripping and smearing clothes and with less stickiness left on hands and had excellent usability. Furthermore, when the face mask was applied for long hours to the face, no stuffiness was felt and low moisture loss of the facial pack lotion occurred.

Additionally, the facial pack lotion was evenly infused inside the fold structure of the folded face mask product and a rate of the facial pack lotion infused was 580 wt %.

Embodiment 7

A face mask base material was prepared by thermally bonding a cotton spun-laced nonwoven fabric (basis weight: 40 g/m$^2$) and a polyethylene film (thickness: 40 $\mu$m) in a punctiform manner.

This sheet base material was wetted using a method provided in JIS L1913 (established in 1998). Values G and E were calculated using the same methods used in Embodiment 1. The sheet base material had a wet bending hardness (G) of 4 (mN·cm) and a tensile elongation percentage (E) of 4%. The base material had moderate flexibility and deforming tolerance as a face mask material.

This sheet base material was punched out using a Thomson blade, and a face mask having knob portions symmetrically on the right and the left as shown in FIG. 1 was made.

After folded in six as shown in FIG. 9, the mask was inserted in a bag made of polyethylene laminated film, and facial pack lotion with viscosity of 1.1 Pa·sec was poured in by weight of 2.5 times more than the dry base material's. The top of the bag was heat-sealed and a sealed product was manufactured.

After opening the sealed bag of the product obtained and taking the product out from the bag, the face mask was expanded by holding the knob portions. The face mask was able to be unfolded easily without its overlapped portions adhering to each other.

Additionally, when applied to the face, the face mask was fitted well and comfortable without excessive facial pack lotion dripping and smearing clothes and with less stickiness left on hands and had excellent usability. Furthermore, when the face mask was applied for long hours to the face, low moisture loss of the facial pack lotion occurred.

Additionally, the facial pack lotion was evenly infused inside the fold structure of the folded face mask product and a rate of the facial pack lotion infused was 240 wt %.

Embodiment 8

A face mask base material was prepared by thermally bonding s cotton spun-laced nonwoven fabric (basis weight: 40 g/m$^2$) and a porous polyethylene film (thickness: 30 $\mu$m) in a punctiform manner.

This sheet base material was wetted using a method provided in JIS L1913 (established in 1998). Values G and E were calculated using the same methods used in Embodiment 1. The sheet base material had a wet bending hardness (G) of 3 (mN·cm) and a tensile elongation percentage (E) of 12%. The base material had moderate flexibility and deforming tolerance as a face mask material.

This sheet base material was punched out using a Thomson blade, and a face mask having three knob portions symmetrically on the right and the left and on the top as shown in FIG. 4 was made.

After folded in six as shown in FIG. 9, the mask was inserted in a bag made of polyethylene laminated film, and facial pack lotion with viscosity of 1.5 Pa·sec was poured in by weight of 1.5 times more than the dry base material's. The top of the bag was heat-sealed and a sealed product was manufactured.

After opening the sealed bag of the product obtained and taking the product out from the bag, the face mask was expanded by holding the knob portions. The face mask was able to be unfolded easily without its overlapped portions adhering to each other.

Additionally, when applied to the face, the face mask was fitted well and comfortable without excessive facial pack lotion dripping and smearing clothes and with less stickiness left on hands and had excellent usability. Furthermore, when the face mask was applied for long hours to the face, no stuffiness was felt and low moisture loss of the facial pack lotion occurred.

Additionally, the facial pack lotion was evenly infused inside the fold structure of the folded face mask product and a rate of the facial pack lotion infused was 130 wt %.

Embodiment 9

A face mask base material was prepared by thermally bonding a rayon spun-laced nonwoven fabric (basis weight: 40 g/m$^2$) and a hot-melt-coated polyethyleneterephthalate film (thickness: 20 $\mu$m) in a punctiform manner.

This sheet base material was wetted using a method provided in JIS L1913 (established in 1998). Values G and E were calculated using the same methods used in Embodiment 1. The sheet base material had a wet bending hardness (G) of 4 (mN·cm) and a tensile elongation percentage (E) of 2%. The base material had moderate flexibility and deforming tolerance as a face mask material.

This sheet base material was punched out using a Thomson blade, and a face mask having knob portions on the left and on the top as shown in FIG. 5 was made.

After folded in four, the mask was inserted in a bag made of polyethylene laminated film, and facial pack lotion with viscosity of 1.7 Pa·sec was poured in by weight of 3.5 times more than the dry base material's. The top of the bag was heat-sealed and a sealed product was manufactured.

After opening the sealed bag of the product obtained and taking the product out from the bag, the face mask was expanded by holding the knob portions. The face mask was able to be unfolded easily without its overlapped portions adhering to each other.

Additionally, when applied to the face, the face mask was fitted well and comfortable without excessive facial pack lotion dripping and smearing clothes and with less stickiness left on hands and had excellent usability. Furthermore, when the face mask was applied for long hours to the face, low moisture loss of the facial pack lotion occurred.

Additionally, the facial pack lotion was evenly infused inside the fold structure of the folded face mask product and a rate of the facial pack lotion infused was 310 wt %.

Embodiment 10

A face mask base material was prepared by inserting a polyethylene film (thickness: 10 $\mu$m) between two cotton spun-laced nonwoven fabrics (basis weight: 25 g/m$^2$) and thermally bonding the materials in a punctiform manner.

This sheet base material was wetted using a method provided in JIS L1913 (established in 1998). Values G and E were calculated using the same methods used in Embodiment 1. The sheet base material had a wet bending hardness (G) of 3 (mN·cm) and a tensile elongation percentage (E) of 16%. The base material had moderate flexibility and deforming tolerance as a face mask material.

This sheet base material was punched out using a Thomson blade, and a face mask having knob portions asymmetrically on the right and the left as shown in FIG. 3 was made.

After folded in six as shown in FIG. 8, the mask was inserted in a bag made of polyethylene laminated film, and facial pack lotion with viscosity of 2.1 Pa·sec was poured in by weight of 4.7 times more than the dry base material's. The top of the bag was heat-sealed and a sealed product was manufactured.

After opening the sealed bag of the product obtained and taking the product out from the bag, the face mask was expanded by holding the knob portions. The face mask was able to be unfolded easily without its overlapped portions adhering to each other.

Additionally, when applied to the face, the face mask was fitted well and comfortable without excessive facial pack lotion dripping and smearing clothes and with less stickiness left on hands and had excellent usability. Furthermore, when the face mask was applied for long hours to the face, low moisture loss of the facial pack lotion occurred.

Additionally, the facial pack lotion was evenly infused inside the fold structure of the folded face mask product and a rate of the facial pack lotion infused was 450 wt %.

Embodiment 11

A face mask base material was prepared by laminating a cotton spun-laced nonwoven fabric (basis weight: 50 g/m$^2$) and a spun-bonded made of polyethyleneterephthalate (basis weight: 25 g/m$^2$) as the synthetic fiber nonwoven fabric and then entwining fibers by hydroentanglement.

This sheet base material was wetted using a method provided in JIS L1913 (established in 1998). Values G and E were calculated using the same methods used in Embodiment 1. The sheet base material had a wet bending hardness (G) of 5 (mN·cm) and a tensile elongation percentage (E) of 12%. The base material had moderate flexibility and deforming tolerance as a face mask material.

This sheet base material was punched out using a Thomson blade, and a face mask having a knob portion on the observer's right as shown in FIG. 6 was made.

After folded in four, the mask was inserted in a bag made of polyethylene laminated film, and facial pack lotion with viscosity of 2.3 Pa·sec was poured in by weight of 6.5 times more than the dry base material's. The top of the bag was heat-sealed and a sealed product was manufactured.

After opening the sealed bag of the product obtained and taking the product out from the bag, the face mask was expanded by holding the knob portion. The face mask was able to be unfolded easily without its overlapped portions adhering to each other.

Additionally, when applied to the face, the face mask was fitted well and comfortable without excessive facial pack lotion dripping and smearing clothes and with less stickiness left on hands and had excellent usability. Furthermore, when the face mask was applied for long hours to the face, no stuffiness was felt and low moisture loss of the facial pack lotion occurred.

Additionally, the facial pack lotion was evenly infused inside the fold structure of the folded face mask product and a rate of the facial pack lotion infused was 630 wt %.

Embodiment 12

A face mask base material was prepared by laminating a rayon spun-laced nonwoven fabric (basis weight: 40 g/m$^2$) and a spun-bonded made of polyethyleneterephthalate (basis weight: 30 g/m$^2$) and then entwining fibers by hydroentanglement.

This sheet base material was wetted using a method provided in JIS L1913 (established in 1998). Values G and E were calculated using the same methods used in Embodiment 1. The sheet base material had a wet bending hardness (G) of 4 (mN·cm) and a tensile elongation percentage (E) of 10%. The base material had moderate flexibility and deforming tolerance as a face mask material.

This sheet base material was punched out using a Thomson blade, and a face mask having knob portions asymmetrically on the right and the left as shown in FIG. 7 was made.

After folded in six as shown in FIG. 8, the mask was inserted in a bag made of polyethylene laminated film, and facial pack lotion with viscosity of 1.9 Pa·sec was poured in by weight of 6 times more than the dry base material's. The top of the bag was heat-sealed and a sealed product was manufactured.

After opening the sealed bag of the product obtained and taking the product out from the bag, the face mask was expanded by holding the knob portions. The face mask was able to be unfolded easily without its overlapped portions adhering to each other.

Additionally, when applied to the face, the face mask was fitted well and comfortable without excessive facial pack lotion dripping and smearing clothes and with less stickiness left on hands and had excellent usability.

By fixing the face mask on the face by putting the ear portions over the ears, the face mask was not misaligned when sleeping with the face mask on overnight, no stuffiness was felt and low moisture loss of the facial pack lotion occurred.

Additionally, the facial pack lotion was evenly infused inside the fold structure of the folded face mask product and a rate of the facial pack lotion infused was 580 wt %.

Embodiment 13

A face mask base material was prepared by thermally bonding a cotton spun-laced nonwoven fabric (basis weight: 40 g/m$^2$) as the cellulose nonwoven fabric and a polyester nonwoven fabric "Eleves"™ (manufactured by UNITIKA LTD, basis weight: 30 g/m$^2$) as the synthetic fiber nonwoven fabric in a punctiform manner.

This sheet base material was wetted using a method provided in JIS L1913 (established in 1998). Values G and E were calculated using the same methods used in Embodiment 1. The sheet base material had a wet bending hardness (G) of 4 (mN·cm) and a tensile elongation percentage (E) of 10%. The base material had moderate flexibility and deforming tolerance as a face mask material.

This sheet base material was punched out using a Thomson blade and a face mask having knob portions symmetrically on the right and left as shown in FIG. 11 was made (Joined places in a punctiform manner are omitted in this figure.).

After folded in six, the mask was inserted in a bag made of polyethylene laminated film, and facial pack lotion with viscosity of 2.0 Pa·sec was poured in by weight of 5.8 times more than the dry base material's. The top of the bag was heat-sealed and a sealed product was manufactured.

After opening the sealed bag of the product obtained and taking the product out from the bag, the face mask was expanded by holding the knob portions. The face mask was able to be unfolded easily without its overlapped portions adhering to each other.

Additionally, because a score was formed in a region dividing the face and the neck, applying the mask to the face, the neck and further the upper chest was easy. Because the face mask was fitted well and had excellent adhesion, the active constituent contained in the face mask were successfully transferred to the skin. Comfort when applied was excellent without excessive facial pack lotion dripping and smearing clothes and with less stickiness left on hands and the face mask had excellent usability. Furthermore, when the face mask was applied for long hours to the face, no stuffiness was felt and low moisture loss of the facial pack lotion occurred.

Additionally, the facial pack lotion was evenly infused inside the fold structure of the folded face mask product and a rate of the facial pack lotion infused was 560 wt %.

COMPARATIVE EXAMPLE 1

A face mask base material was prepared using a cotton spun-laced nonwoven fabric (basis weight: 30 g/m ) only, as the cellulose nonwoven fabric.

This sheet base material was wetted using a method provided in JIS L1913 (established in 1998). Values G and E were calculated using the same methods used in Embodiment 1. The sheet base material had a wet bending hardness (G) of 1 (mN·cm) and a tensile elongation percentage (E) of 55%.

This sheet base material was punched out using a Thomson blade, and a face mask having knob portions symmetrically on the right and the left as shown in FIG. 1 was made.

After folded in six as shown in FIG. 9, the mask was inserted in a bag made of polyethylene laminated film, and facial pack lotion with viscosity of 1.7 Pa·sec was poured in by weight of 7.5 times more than the dry base material's. The top of the bag was heat-sealed and a sealed product was manufactured.

After opening the sealed bag of the product obtained and taking the product out from the bag, the face mask was expanded by holding the knob portions. The face mask was not able to be expanded easily with its overlapped portions adhering to each other.

If attempting to unfold the face mask forcibly, the sheet base material was deformed and the face mask was not able to be fitted to the face well. Additionally, applying the face mask to the face caused dripping of excessive facial pack lotion; clothes were smeared; hands became sticky; usability of the facial mask was exceedingly bad.

Additionally, a rate of the facial pack lotion infused in the folded face mask was 710 wt %.

COMPARATIVE EXAMPLE 2

A face mask base material was prepared using a cotton spun-laced nonwoven fabric (basis weight: 40 g/m$^2$) only, as cellulose nonwoven fabric.

This sheet base material was wetted using a method provided in JIS L1913 (established in 1998). Values G and E were calculated using the same methods used in Embodiment 1. The sheet base material had a wet bending hardness (G) of 2 (mN·cm) and a tensile elongation percentage (E) of 46%.

This sheet base material was punched out using a Thomson blade, and a face mask having knob portions symmetrically on the right and the left as shown in FIG. 1 was made.

After folded in six as shown in FIG. 9, the mask was inserted in a bag made of polyethylene laminated film, and facial pack lotion with viscosity of 0.6 Pa·sec was poured in by weight of 7 times more than the dry base material's. The top of the bag was heat-sealed and a sealed product was manufactured.

After opening the sealed bag of the product obtained and taking the product out from the bag, the face mask was expanded by holding the knob portions. Due to tight adhesion at its overlapped portions, it was difficult to expand the face mask.

If attempting to expand the face mask forcibly, the sheet base material was deformed and the face mask could not be fitted to the face well. Additionally, applying the face mask to the face caused dripping of excessive facial pack lotion; clothes were smeared; hands became sticky; usability of the facial mask was exceedingly bad.

Additionally, a rate of the facial pack lotion infused in the folded face mask was 680 wt %.

COMPARATIVE EXAMPLE 3

A face mask base material was prepared using a cotton spun-laced nonwoven fabric (basis weight: 90 g/m$^2$) only, as cellulose nonwoven fabric.

This sheet base material was wetted using a method provided in JIS L1913 (established in 1998). Values G and E were calculated using the same methods used in Embodiment 1. The sheet base material had a wet bending hardness (G) of 12 (mN·cm) and a tensile elongation percentage (E) of 13%.

This sheet base material was punched out using a Thomson blade, and a face mask having knob portions symmetrically on the right and the left as shown in FIG. 1 was made.

After folded in six as shown in FIG. 9, the mask was inserted in a bag made of polyethylene laminated film, and facial pack lotion with viscosity of 1.3 Pa·sec was poured in by weight of 6.7 times more than the dry base material's. The top of the bag was heat-sealed and a sealed product was manufactured.

After opening the sealed bag of the product obtained and taking the product out from the bag, the face mask was expanded by holding the knob portions. The face mask was able to be expanded well. Because the face mask itself was coarse and stiff, it was difficult to remove folds caused by folding the face mask and fittedness of the face mask to the face was exceedingly bad.

Additionally, a rate of the facial pack lotion infused in the folded face mask was 650 wt %.

COMPARATIVE EXAMPLE 4

A face mask base material was prepared by thermally bonding a rayon spun-laced nonwoven fabric (basis weight: 40 g/m$^2$) as the cellulose nonwoven fabric and "Eleves"™ (manufactured by UNITIKA LTD., basis weight: 30 g/m$^2$) as the synthetic fiber nonwoven fabric in a punctiform manner.

This sheet base material was wetted using a method provided in JIS L1913 (established in 1998). Values G and E were calculated using the same methods used in Embodiment 1. The sheet base material had a wet bending hardness (G) of 3 (mN·cm) and a tensile elongation percentage (E) of 5%. The base material had moderate flexibility and deforming tolerance as a face mask material.

This sheet base material was punched out using a Thomson blade, and a face mask without any knob portions as shown in FIG. 10 was made.

After folded in six as shown in FIG. 9, the mask was inserted in a bag made of polyethylene laminated film, and facial pack lotion with viscosity of 3.1 Pa·sec was poured in by weight of 6 times more than the dry base material's. The top of the bag was heat-sealed and a sealed product was manufactured.

After opening the sealed bag of the product obtained and taking the product out from the bag, unfolding the face mask was attempted. Due to high viscosity of the facial pack lotion and no knob portion available, it was hard to expand the face mask. While attempting to expand the face mask, dripping of excessive facial pack lotion smeared clothes and left stickiness on hands and usability of the face mask was bad.

Additionally, a rate of the facial pack lotion infused of this product was 590 wt %.

Table 1 summarizes physical properties and facial pack lotion impregnation rates in reinforced conditions and respective conditions in the above-mentioned embodiments and comparative examples and usability of face masks obtained.

TABLE 1

| No. | Cellulose Nonwoven Fabric Material/Basis Weight | | Knob Portion | | Reinforced by Synthetic Fabric | |
|---|---|---|---|---|---|---|
| | | ($g/m^2$) | Number | Position | Method | Usage Ratio |
| Embodiment 1 | Cotton | 30 | 1 FIG. 2. | Left | Polyester nonwoven fabric (Eleves) bonded in punctiform manner | Eleves Basis wt.: 20 $g/m^2$ |
| Embodiment 2 | Cotton | 30 | 2 FIG. 1 | Right and left/ symmetrically | Polyester nonwoven fabric spunlace | Rayon/Polyester, 70/30 (weight ratio) |
| Embodiment 3 | Cotton | 40 | 2 FIG. 1 | Right and left/ symmetrically | Nylon 6 nonwoven fabric laminated/ hydroentanglement | Nylon 6 nonwoven fabric Basis wt.: 30 $g/m^2$ |
| Embodiment 4 | Cotton | 40 | 2 FIG. 3 | Right and left/ symmetrically | Nylon 6 mesh fabric/ hydroentanglement | Nylon 6 mesh fabric Basis wt.: 25 $g/m^2$ |
| Embodiment 5 | Rayon | 40 | 2 FIG. 1 | Right and left/ symmetrically | Polyester nonwoven fabric (Eleves) bonded in punctiform manner | Eleves Basis wt.: 30 $g/m^2$ |
| Embodiment 6 | Rayon | 40 | 2 FIG. 3 | Right and left/ asymmetrically | Polyester nonwoven fabric laminated/ hydroentanglement | Polyester (PET) nonwoven fabric Basis wt.: 30 $g/m^2$ |
| Embodiment 7 | Cotton | 40 | 2 FIG. 1 | Right and left/ symmetrically | — | — |
| Embodiment 8 | Rayon | 40 | 3 FIG. 4 | Right, left & top | — | — |
| Embodiment 9 | Rayon | 40 | 2 FIG. 5 | Top and left | — | — |
| Embodiment 10 | Cotton | 25 × 2 pc. | 2 FIG. 3 | Right and left/ asymmetrically | — | — |
| Embodiment 11 | Cotton | 50 | 1 FIG. 6 | Right | Polyester nonwoven fabric laminated/ hydroentanglement | Polyester (PET) nonwoven fabric Basis wt.: 25 $g/m^2$ |
| Embodiment 12 | Rayon | 40 | 2 FIG. 7 | Putting on ears | Polyester nonwoven fabric laminated/ hydroentanglement | Polyester (PET) nonwoven fabric Basis wt.: 30 $g/m^2$ |
| Embodiment 13 | Cotton | 40 | 2 FIG. 11 | Right and left/ symmetrically | Polyester nonwoven fabric (Eleves) bonded in punctiform manner | Eleves Basis wt.: 30 $g/m^2$ |
| Comp. Ex. 1 | Cotton | 30 | 2 FIG. 1 | Right and left/ symmetrically | — | — |
| Comp. Ex. 2 | Cotton | 40 | 2 FIG. 1 | Right and left/ symmetrically | — | — |
| Comp. Ex. 3 | Cotton | 90 | 2 FIG. 1 | Right and left/ symmetrically | — | — |
| Comp. Ex. 4 | Rayon | 40 | None FIG. 10 | — | Polyester nonwoven fabric (Eleves) bonded in punctiform manner | Eleves Basis wt.: 30 $g/m^2$ |

| No. | Reinforced by Synthetic Film (Bonded) | | |
|---|---|---|---|
| | Film Material | Thickness ($\mu m$) | Figuration |
| Embodiment 1 | — | — | — |
| Embodiment 2 | — | — | — |
| Embodiment 3 | — | — | — |
| Embodiment 4 | — | — | — |
| Embodiment 5 | — | — | — |
| Embodiment 6 | — | — | — |
| Embodiment 7 | Polyethylene | 40 | Point contact |
| Embodiment 8 | Porous polyurethane | 30 | Point contact |
| Embodiment 9 | Polyethylene-terephthalate | 20 | Point contact |
| Embodiment 10 | Polyethylene | 10 | Sandwich type Point contact |
| Embodiment 11 | — | — | — |
| Embodiment 12 | — | — | — |
| Embodiment 13 | — | — | — |
| Comp. Ex. 1 | — | — | — |
| Comp. Ex. 2 | — | — | — |
| Comp. Ex. 3 | — | — | — |
| Comp. Ex. 4 | — | — | — |

TABLE 1-continued

| No. | Wet Tensile Elongation Percentage E (%) | Wet Bending Hardness G (mN-cm) | Facial Pack Lotion Viscosity (Pa-sec) | Impregnation Rate of Facial Pack Lotion (wt %) | Usability |
|---|---|---|---|---|---|
| Embodiment 1 | 8 | 2 | 2.3 | 530 | ○ |
| Embodiment 2 | 19 | 1 | 4.7 | 690 | ○ |
| Embodiment 3 | 13 | 2 | 2.4 | 510 | ○ |
| Embodiment 4 | 10 | 1 | 5.7 | 720 | ○ |
| Embodiment 5 | 4 | 3 | 2.2 | 280 | ○ |
| Embodiment 6 | 11 | 4 | 2 | 580 | ○ |
| Embodiment 7 | 4 | 4 | 1.1 | 240 | ○ |
| Embodiment 8 | 12 | 3 | 1.5 | 130 | ○ |
| Embodiment 9 | 2 | 4 | 1.7 | 310 | ○ |
| Embodiment 10 | 16 | 3 | 2.1 | 450 | ○ |
| Embodiment 11 | 12 | 5 | 2.3 | 630 | ○ |
| Embodiment 12 | 10 | 4 | 1.9 | 580 | ○ |
| Embodiment 13 | 10 | 4 | 2.0 | 560 | ○ |
| Comp. Ex. 1 | 55 | 1 | 1.7 | 710 | x |
| Comp. Ex. 2 | 46 | 2 | 0.6 | 680 | x |
| Comp. Ex. 3 | 13 | 12 coarse/stiff | 1.3 | 650 | x |
| Comp. Ex. 4 | 5 | 3 | 3.1 | 590 | x |

When opening the sealed bag, taking the face mask out of the bag, and expanding it by holding the knob portions, the face mask according to an embodiment of the present invention was expanded easily without overlapped portions adhering to each other. By applying the face mask to the face after unfolding it, it was fitted well and usability was excellent. Excessive facial pack lotion did not drip from the face mask, hence did not smear clothes, and there was less stickiness left on hands. Additionally, when the face mask was applied for long hours to the face, there was low moisture loss of the facial pack lotion caused by evaporation.

What is claimed is:

1. An impregnation type face mask having at least one knob portion projecting outward and being folded, said face mask comprising a reinforced cellulose nonwoven fabric as a sheet base material, said sheet base material having a basis weight of 60 g/m$^2$ or less, an elongation percentage of 30% or less at a tensile stress of 3.9 N/5 cm when being wetted, and a relative bending resistance of 5 mN·cm or less when being wetted, said face mask being impregnated with a facial pack lotion with a viscosity of 0.5 to 10 Pa·sec in an amount of 50 wt % or more based on the weight of the sheet base material.

2. The face mask as claimed in claim 1, wherein said cellulose nonwoven fabric sheet is a sheet base material which is reinforced by combining a cellulose raw material with a synthetic fiber.

3. The face mask as claimed in claim 1, wherein the facial pack lotion has a viscosity of 0.8 to 8 Pa·sec.

4. The face mask as claimed in claim 1, wherein said cellulose nonwoven fabric is reinforced by superposing on one side or interposing a resin film having pores.

5. The face mask as claimed in claim 4, wherein said superposed resin film is thermally bonded in a punctiform manner.

6. The face mask as claimed in claim 1, wherein the facial pack lotion has a viscosity of 0.8 to 3 Pa·sec.

7. The face mask as claimed in claim 1, which has a shape covering a face and a neck and has a score formed at least in a region dividing the face and the neck.

8. The face mask as claimed in claim 1, which has a structure having portions to be placed over ears to secure the attachment of the face mask on the entire face.

9. The face mask as claimed in claim 1, wherein said cellulose nonwoven fabric is reinforced by superposing on one side or interposing a resin film.

* * * * *